US006837880B2

(12) United States Patent
Trimble

(10) Patent No.: US 6,837,880 B2
(45) Date of Patent: Jan. 4, 2005

(54) DIAPER SHEET COMBINATION

(76) Inventor: Lynn Trimble, 17772 Bridge La., Jupiter, FL (US) 33478

( * ) Notice: Subject to any disclaimer, the term of this patent is extended or adjusted under 35 U.S.C. 154(b) by 200 days.

(21) Appl. No.: 10/157,665

(22) Filed: May 29, 2002

(65) Prior Publication Data

US 2003/0222111 A1 Dec. 4, 2003

(51) Int. Cl.[7] ..... A61F 13/15

(52) U.S. Cl. ..... 604/393; 604/385.01; 128/872; 128/873; 5/426; 5/494

(58) Field of Search ..... 604/393, 385.01, 604/385.06, 385.13; 128/872, 873, 876; 5/424, 655, 494–504.1

(56) References Cited

U.S. PATENT DOCUMENTS 3,276,432 A * 10/1966 Murcott ..... 128/874
4,745,926 A * 5/1988 Hlusko ..... 128/873
4,931,052 A * 6/1990 Feldman ..... 604/385.06
5,141,505 A * 8/1992 Barrett ..... 604/385.13
5,193,238 A * 3/1993 Clute ..... 5/655
5,233,714 A * 8/1993 De Bell Daniel ..... 5/655
5,304,158 A * 4/1994 Webb ..... 604/385.13
RE34,763 E * 10/1994 Tucker ..... 5/482

* cited by examiner

*Primary Examiner*—John J. Calvert
*Assistant Examiner*—Jacqueline F. Stephens
(74) *Attorney, Agent, or Firm*—McHale & Slavin

(57) ABSTRACT

A combination diaper and holder secures a baby in a safe and comfortable position while unattended by an adult. The holder is formed of a sheet large enough to fit about a crib mattress or, at least one end of the mattress. The holder has elongated straps for placement about the mattress. A diaper having front and back waistband portions connected by a crotch section is attached to the middle portion of the holder by fastening through one of the waistband portions. The waistband portions each have cooperating fasteners on the ends. The crotch section and the other unattached waistband portion is folded through the baby's legs and the cooperating fasteners are secured to fix the baby within the diaper and on the sheet. A wedge shaped pillow may be provided for elevating the baby. The holder is attached to the wedge shaped pillow by the straps.

6 Claims, 2 Drawing Sheets

DIAPER SHEET COMBINATION

FIELD OF THE INVENTION

This invention relates to the field of infant care and particularly, to securing the baby in a safe position while asleep or unattended by an adult.

BACKGROUND OF THE INVENTION

Crib deaths have been extensively reported by the scientific community and the media. The notoriety has heightened the public's awareness of this serious problem. While particular cases can be distinguished by physical characteristics of the baby or by examining the surroundings in which the death occurred, there is a general conclusion that certain situations should be avoided. For example, bedclothes in which the baby can become entangled should not be used nor should babies be allowed to lay flat on their stomachs for extended periods of time.

DESCRIPTION OF THE PRIOR ART

The "Tucker Sling"™ has a pocket portion that fits over the end of a bed much like a fitted sheet. An attached lower portion has a large wrap-around part that covers most of the baby's torso and a crotch section fastened together to form a garment Pedicraft products markets reflux wedges designed to hold the baby at a 30 degree angle to prevent choking. The wedges are made of foam and covered with a nonabsorbent vinyl material including a garment.

U.S. Pat. No. 5,193,238 to Clute discloses a blanket or sheet with attached wedges that are oriented to extend along both sides of a baby.

U.S. Pat. No. 4,745,926 to Hlusko discloses reflux pants having a diaper-type garment with suspenders for holding the baby in one position. The suspenders have attachments for connecting them to an inclined bed.

What is needed in the art is a less cumbersome combination of a sheet and attached diaper that has a minimum of fabric and can be easily and quickly installed and removed from a support.

SUMMARY OF THE INVENTION

Accordingly, it is an objective of the instant invention to teach a diaper sheet combination having a set of straps for securing the combination in place on a support.

It is a further objective of the instant invention to teach a half sheet with depending diaper for attaching to a mattress.

It is yet another objective of the instant invention to teach the diaper sheet combination used with a wedge for elevating the wearer.

It is a still further objective of the invention teach an absorbent diaper having fasteners at the waistband for securing the diaper about the wearer.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE INVENTION

Figure 1:
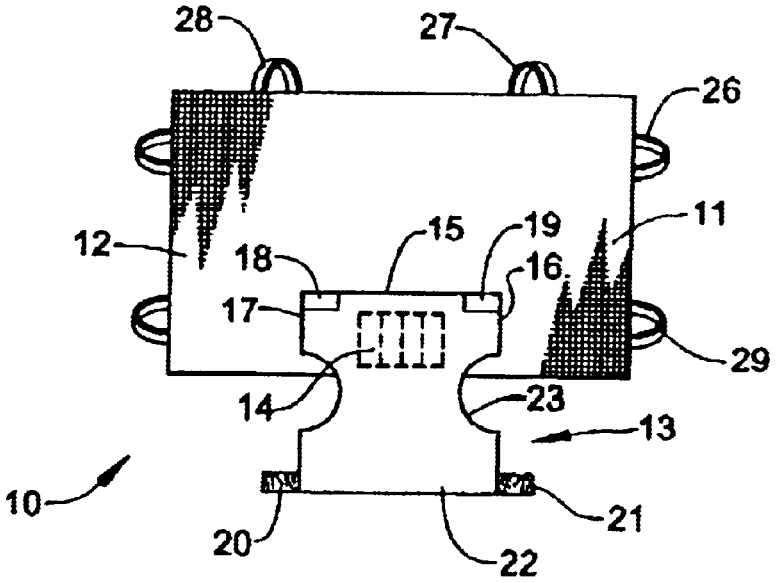
FIG. 1 is a plan view of one side of the diaper sheet combination.

The diaper sheet combination 10, shown in the drawings, has a flat, thin, and flexible swath of material 11 which forms a surface for contacting the wearer's head and upper torso. The material may be absorbent or non-absorbent, woven, knitted, nonwoven, pervious or impervious. The sheet serves as a soft comfortable surface to contact the baby and to protect the support or mattress under the sheet.

The material 11 may be of a size to extend across the width of a crib mattress, other mattresses or smaller to merely conform to the baby's body. The length of the material is such to cover the area between the baby's head and hips. Of course, smaller or larger dimensions may be used.

On one surface 12 of the sheet material a diaper 13 superposed and attached by sewing, adhesives, heat and pressure or other means. The attachment area 14 is confined to one end of the diaper between the lateral edges. The opposite ends of the waistband 15 are free from attachment so that they can be wrapped about the baby's waist.

The opposite ends 16 and 17 have fasteners 18 and 19 which cooperate with fasteners 20 and 21 on the other waistband 22 to secure the diaper about the baby's waist. The fasteners may be adhesive, cohesive, VELCRO, buttons and holes, male and female snaps or other types.

The other end of the diaper is shown extending beyond the periphery of the sheet material 11. This portion of the diaper is folded upwardly to engage the cooperating fasteners and the crotch section 23 is placed between the baby's legs.

Figure 2:
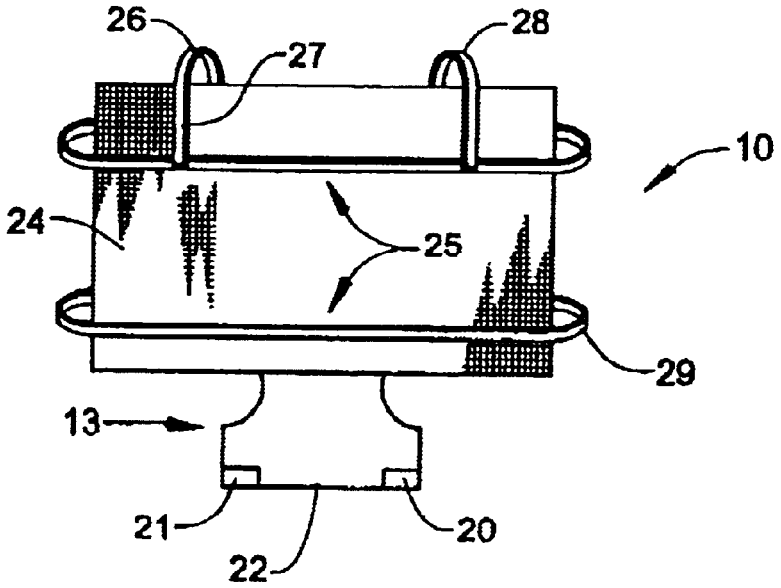
FIG. 2 is a plan view of the other side of the diaper sheet combination.

The other side 24 of the material 11 has a set of straps 25 for connecting the diaper sheet combination to a support. As shown in FIG. 2, the straps 25 are attached at their ends about the periphery of the material and form unattached loops for surrounding a portion of a support. As shown, the portion of the sheet which will be near the baby's head has a lateral strap 26 extending across the entire width of the sheet. The lateral strap is connected between its ends to two vertical straps 27 and 28 which are connected to the upper periphery of the material 11. This stabilizes the upper edge of the material against twisting and bunching as the baby turns. The bottom edge of the sheet has another lateral strap 29 to secure the other end of the material to the support. These straps may be elastic or non-elastic with length adjusting buckles. The ends of the straps may be permanently attached to the periphery of the sheet by sewing, adhesive, or other types of fasteners. The straps may be removable for cleaning or laundry, in which case the straps are attached by openable fasteners, such as buttons, snaps etc.

Figure 3:
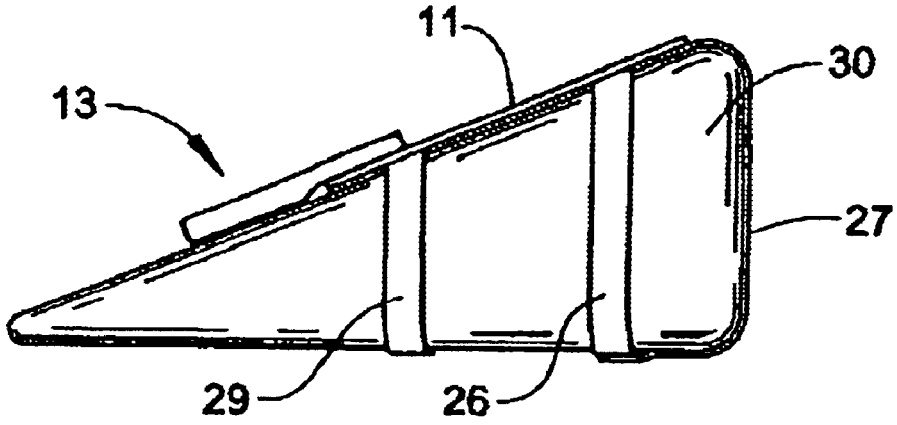
FIG. 3 is a side view of the diaper sheet combination in place on a wedge.

In FIG. 3, the diaper sheet combination is shown with a wedge 30 for elevating the baby's head. The wedge may be a separate item from the support or it may be integral with a mattress.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A combination diaper and holder for temporary attachment to a support comprising a large flexible sheet having two sides and a periphery, a diaper having an attached waistband portion and a free waistband portion connected by a crotch portion therebetween, said attached waistband portion overlying one side of said sheet and connected to said sheet, said attached waistband portion and said free waistband portion being discontinuous with opposed ends, said opposed ends each having cooperating fastening means for closing said waistband portions, elongated straps attached at their ends within said periphery on the second side of said sheet, said elongated straps forming loops to engage a support for securing said holder.

2. A combination diaper and holder of claim 1 further comprising a third elongated strap connected at each end to said periphery on the second side of said sheet, said third elongated strap being displaced from said second elongated strap.

3. A combination diaper and holder of claim 1 further comprising said sheet of a size approximating the width of a baby mattress.

4. A combination diaper and holder of claim 3 further comprising said sheet of a size approximating one half the length of a baby mattress.

5. A combination diaper and holder of claim 1 further comprising said sheet of a size approximating one half the length of a baby mattress.

6. A combination diaper and holder of claim 1 further comprising said support being a wedge shaped pillow, said loops of said elongated straps extending around said pillow.

* * * * *